US008052553B2

(12) United States Patent
Jones

(10) Patent No.: US 8,052,553 B2
(45) Date of Patent: Nov. 8, 2011

(54) SYSTEM FOR ADJUSTING ARCHERY BOW AND ARROWS

(76) Inventor: Zac Jones, Price, UT (US)

( * ) Notice: Subject to any disclaimer, the term of this patent is extended or adjusted under 35 U.S.C. 154(b) by 591 days.

(21) Appl. No.: 12/183,019

(22) Filed: Jul. 30, 2008

(65) Prior Publication Data

US 2009/0032004 A1 Feb. 5, 2009

Related U.S. Application Data

(60) Provisional application No. 60/962,820, filed on Jul. 31, 2007.

(51) Int. Cl.
*F42B 6/04* (2006.01)

(52) U.S. Cl. ..... 473/578

(58) Field of Classification Search ..... 473/578, 473/582, 585, 586; 33/379
See application file for complete search history.

(56) References Cited

U.S. PATENT DOCUMENTS

| | | | | | |
|---|---|---|---|---|---|
| 1,654,248 | A | * | 12/1927 | Erdmann | 33/348 |
| 3,854,217 | A | * | 12/1974 | Killian | 33/265 |
| 4,580,350 | A | * | 4/1986 | Fincher | 33/334 |
| 5,303,479 | A | * | 4/1994 | Rudovsky | 33/265 |
| 5,431,391 | A | * | 7/1995 | Tracey | 473/257 |
| 5,630,279 | A | * | 5/1997 | Slates | 33/265 |

* cited by examiner

*Primary Examiner* — John Ricci
(74) *Attorney, Agent, or Firm* — Bateman IP; Brett Peterson

(57) ABSTRACT

A system for adjusting archery bows and arrows allows for easy adjustment thereof. The system allows an archery bow to be setup to provide for linear motion of the arrow in exiting the bow and provides for accurate shooting thereof. The system accommodates the natural shooting posture of the shooter. The system may also be used to verify the squareness and accuracy of arrow tips and inserts to ensure that arrow heads are attached squarely to the arrow. The system thus allows the accuracy of the arrow construction to be verified.

9 Claims, 6 Drawing Sheets

SYSTEM FOR ADJUSTING ARCHERY BOW AND ARROWS

RELATED APPLICATIONS

The present application claims the benefit of U.S. Provisional Application Ser. No. 60/962,820, filed Jul. 31, 2007, which is expressly incorporated herein in its entirety.

BACKGROUND OF THE INVENTION

1. The Field of the Invention

The present invention relates to a system for adjusting archery bows and arrows. More specifically, the present invention relates to a level for adjusting bows and ensuring the accuracy of arrows.

2. State of the Art

Archery has become a common sport. Many persons use a bow and arrows for recreational target practice, hunting, etc. It is important that a person's bow and arrows are accurate and properly set up. Improperly set up or inaccurate bows and arrows result in inaccurate shooting. If a bow is not properly set up, the arrow will likely miss the intended target.

Similarly, arrows should be properly constructed for accurate shooting. If the arrows are not properly constructed, the arrow may wobble or curve as it flies, most likely missing the intended target. Imbalance of am improperly aimed arrow head, for example, may prevent the arrow from flying straight. Many arrow heads used in hunting include blades which extend laterally from the arrow head. If the arrow head is not properly aligned, these blades may prevent the arrow from flying in a straight path. It will thus be appreciated that there is a need for a device which allows a person to correctly adjust a bow and to verify the correct geometry of an arrow to achieve accuracy in shooting the same.

SUMMARY OF THE INVENTION

It is an object of the present invention to provide an improved system for adjusting and verifying the accuracy of archery bows and arrows.

According to one aspect of the invention, a bubble level is provided which is attached to the tip of an arrow. The level may be used to adjust a bow and properly set up the bow. According to another aspect of the invention, the level is removable from the arrow, and may be placed on the tip of different arrows to verify the accuracy of the arrow.

These and other aspects of the present invention are realized in a system for adjusting archery bows and arrows as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
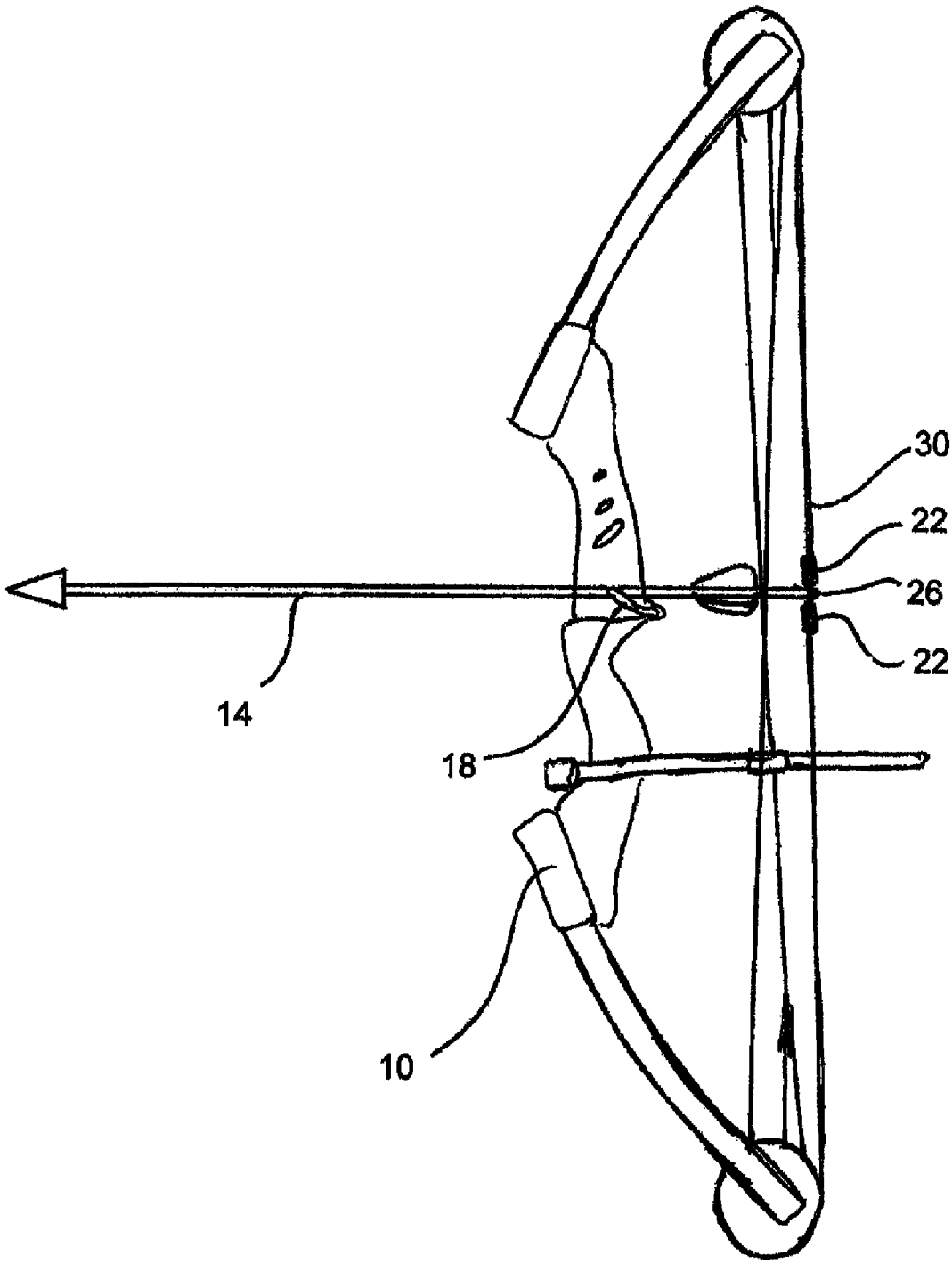
FIG. 1 shows a side view of an archery bow as known in the art.
Figure 2:
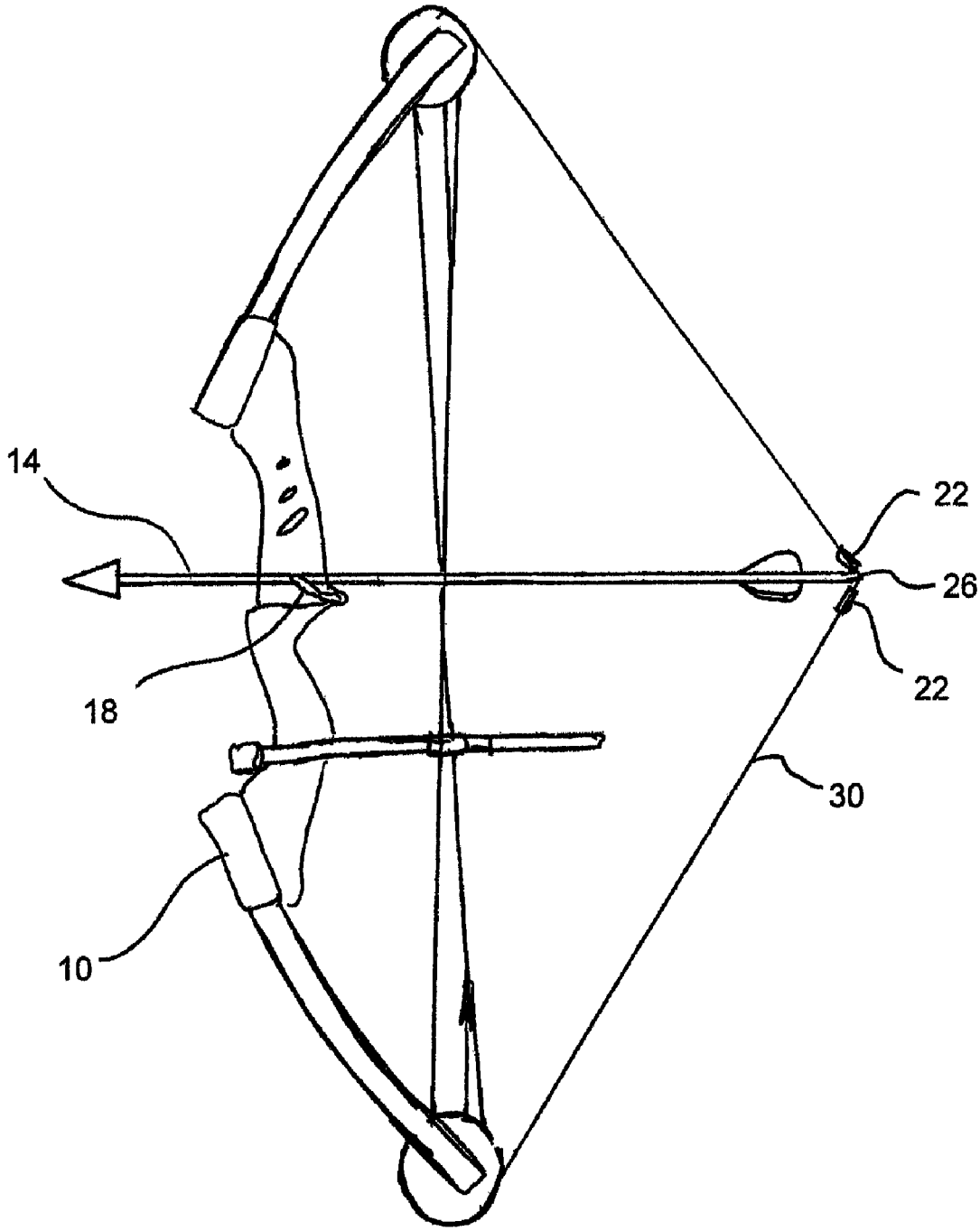
FIG. 2 shows another side view of the bow of FIG. 2 as known in the art.

Turning now to FIGS. 1 and 2, side views of a compound bow 10 as is known in the art are shown. As compound bows and bows in general are well known in the art, features or structures not necessary for an understanding of the present invention will not be discussed herein. The bow 10 is used to shoot an arrow 14 for recreational target practice, hunting, etc. The bow 10 includes an arrow rest 18 which supports the arrow 14 and nock points 22 which position the nock 26 of the arrow 14 on the bow string 30.

Typically, the nock points 22 and arrow rest 18 are adjustable to control the position of the resting arrow 14. It is desirable that the arrow 14 is square to the string 30, and more desirable that the arrow 14 moves linearly back and forth as the arrow is drawn and released. Additionally, it would be desirable to be able to accurately set up a bow 10 for a persons shooting style, allowing the arrow 14 to travel linearly back and forth as the arrow is drawn and released even if the arrow is not perfectly perpendicular to the string 30. If the arrow 14 pivots while being drawn or released, the accuracy of the shot is compromised. The position and alignment of the arrow 14 is adjusted according to a bow sight (not shown). Once the nock points 22 and arrow rest 18 have been properly adjusted, the bow 10 will shoot accurately and repeatedly (with accurately constructed arrows). It is, however, difficult to properly adjust the bow 10.

Figure 3:
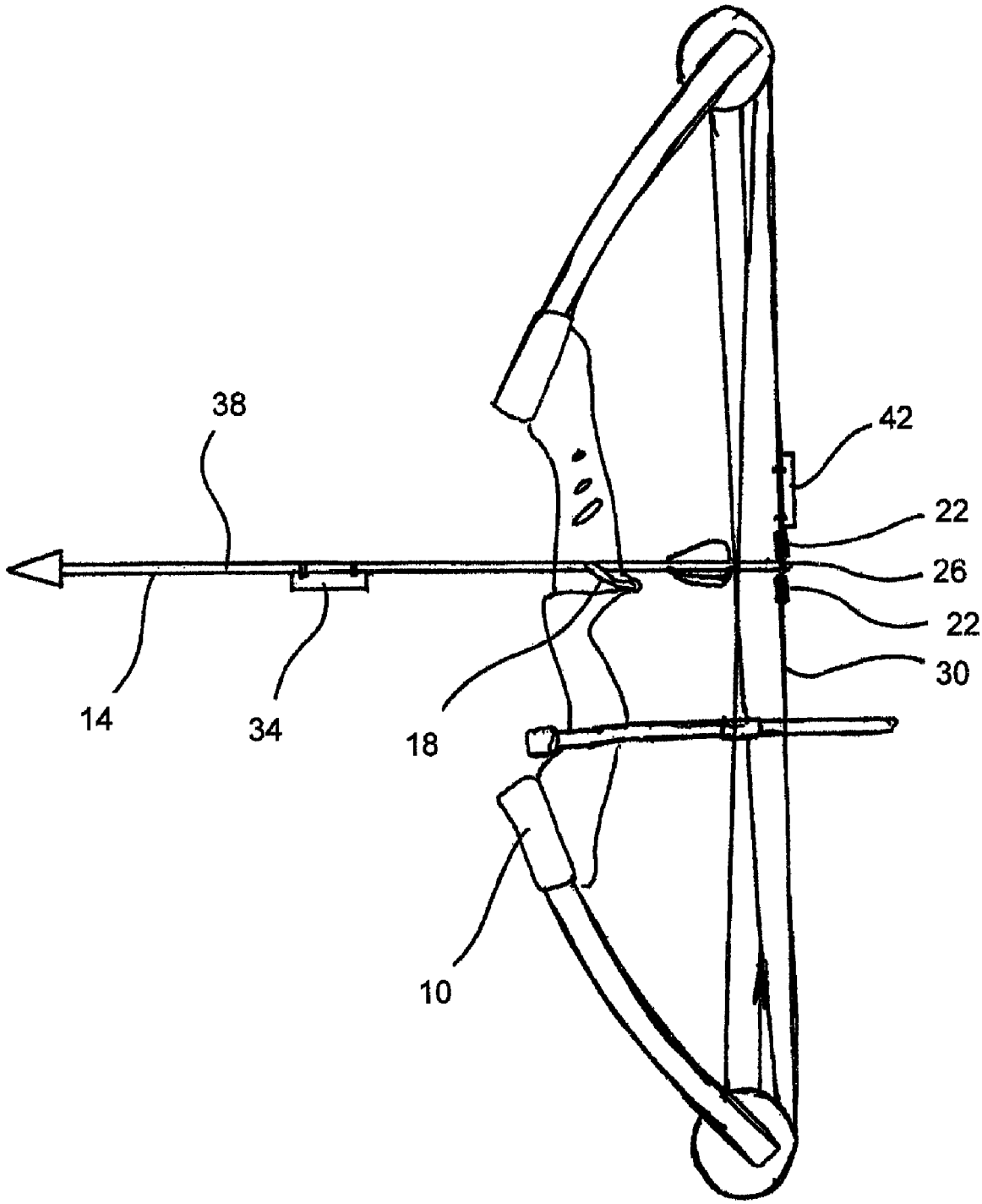
FIG. 3 shows a prior art system for adjusting the bow of FIG. 1.

FIG. 3 shows a prior art device for adjusting the bow 10 for proper shooting. The device includes a first bubble level 34 which is clipped onto the arrow shaft 38 and a second bubble level 42 which is clipped onto the string 30. The bubble levels 34, 42 are used to adjust the arrow rest 18 and nock points 22 to position the arrow perpendicular to the string 30. While functional, the prior art device suffers from drawbacks. For example, the device requires a person to monitor two levels 34, 42 while moving and adjusting the nock points 22 and arrow rest 18. It is difficult to monitor both levels. Additionally, the device does not accommodate the different shooting styles of different individuals.

Figure 4A:
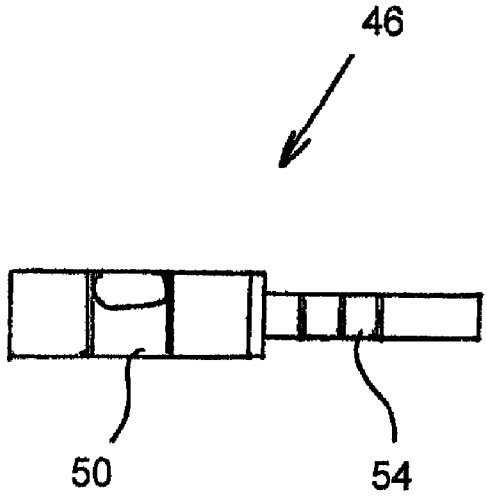
FIG. 4A and FIG. 4B show a level for adjusting a bow and arrow according to the present invention.
Figure 4B:
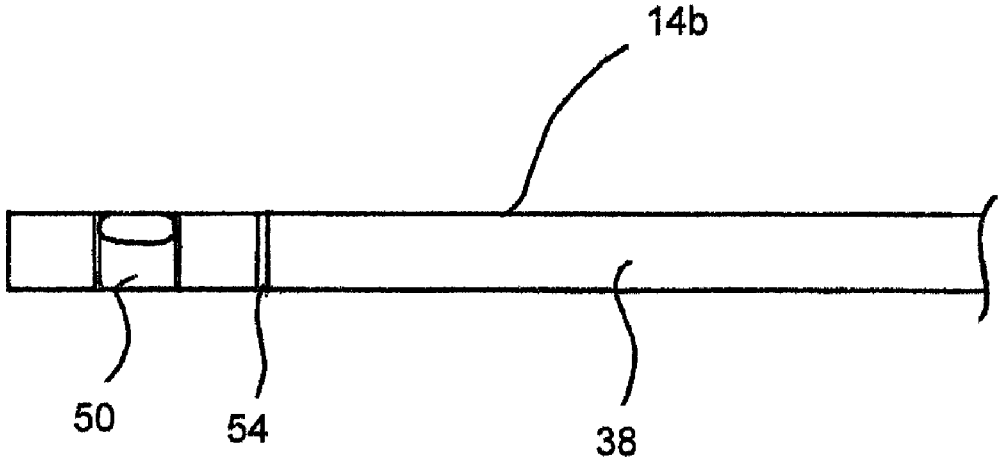

FIG. 4A shows an adjusting level 46 according to the present invention. The level 46 includes a bubble level 50 attached to a stem 54. The stem 54 is sized to be inserted into an arrow shaft 38. Typically, arrows have a hollow shaft 38 with an insert (58 of FIG. 5B) that is pressed into or bonded into the front of the arrow shaft 38. The insert 58 allows different arrow tips to be used with the arrow 14. The stem 54 of the level 46 is similarly pressed or bonded into an arrow shaft 38 to create a setup arrow 14*b* for adjusting a bow 10. The bubble level 50 is a cylindrical (axially symmetrical)

level which functions with any side up, and is placed in axial alignment with the arrow shaft 38 as shown in FIG. 4B.

The resulting setup arrow 14*b* is a permanent arrow which may be used to adjust different bows. A sporting goods store may keep such an arrow at the store for use in adjusting customer's bows 10. A hunter may keep such an arrow at home or in a vehicle for use in adjusting their bow 10. While the setup arrow 14*b* is a dedicated arrow and can not be used for hunting, the alignment of the bubble level 50 and arrow shaft 38 is fixed and accurate and provides accuracy in adjusting a bow 10.

Figure 5A:
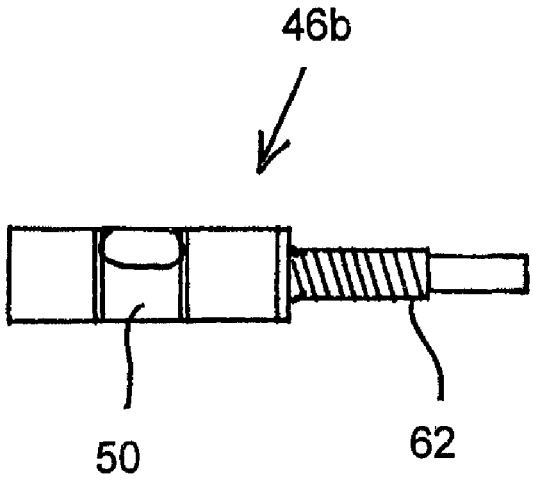
FIG. 5A and FIG. 5B show another level for adjusting a bow and arrow according to the present invention.
Figure 5B:
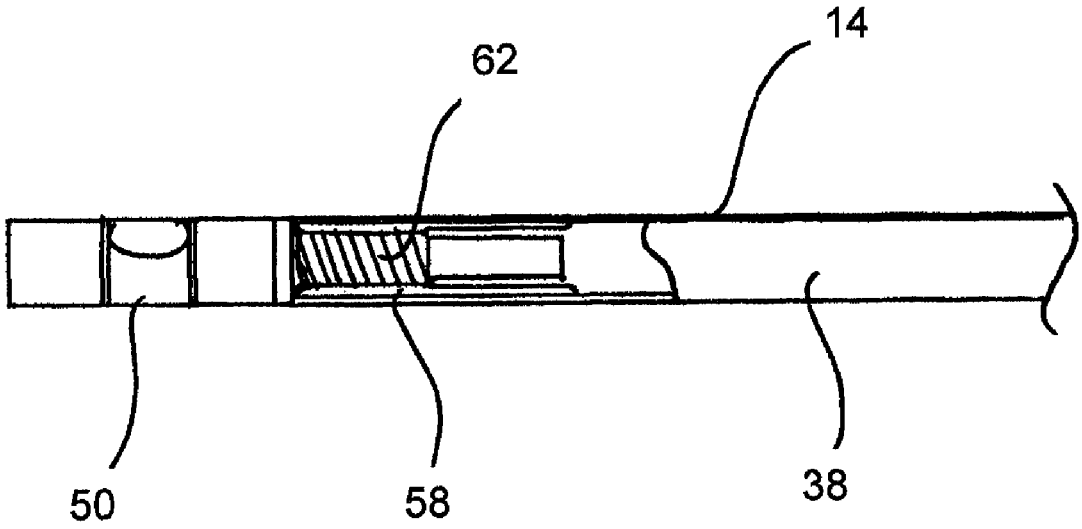

FIG. 5A shows another adjusting level 46*b* according to the present invention. The adjusting level 46*b* includes a bubble level 50 and a threaded stem 62 which is sized and configured for threaded insertion into a conventional arrow insert 58 in place of an arrow head, as is shown in FIG. 5B. FIG. 5B shows a partially cut-away view of an arrow shaft 38 and insert 58 to show how the stem 62 is threaded into the arrow 14 to create a setup arrow. The stem 62 may be made with different sizes of threads to accommodate different types of arrow inserts 58.

The adjusting level 46*b* shown in FIGS. 5A and 5B is advantageous as it is small and removably attached to the arrow 14. The level 46*b* may thus be carried in a pocket and taken when hunting or shooting to ensure accuracy of the bow 10. The level 46*b* is also advantageous as it allows a person to verify the proper construction of their arrows 14. It will be appreciated that if the front of the arrow shaft 38 is not cut square, or if the insert 58 is not squarely attached to the shaft, the arrow head will not squarely attach to the arrow 14. This will typically cause the arrow to wobble in flight and reduce the accuracy of the arrow. This effect is especially pronounced with broadhead arrows which have blades extending laterally from the arrow head.

The adjusting level 46*b* allows a person to check the construction of the arrow 14. The level 46*b* is threaded into the insert 58 and the arrow is rolled across a table or held level and rotated. Misalignment of the end of the shaft 38 or insert 58 will be manifest in movement of the bubble in the bubble level 50 and will be more easily observed than simply observing for movement of an arrow head while rotating the arrow. Thus, a person may check the accuracy of their arrows and determine if some arrows need to be rebuilt or discarded.

Figure 6:
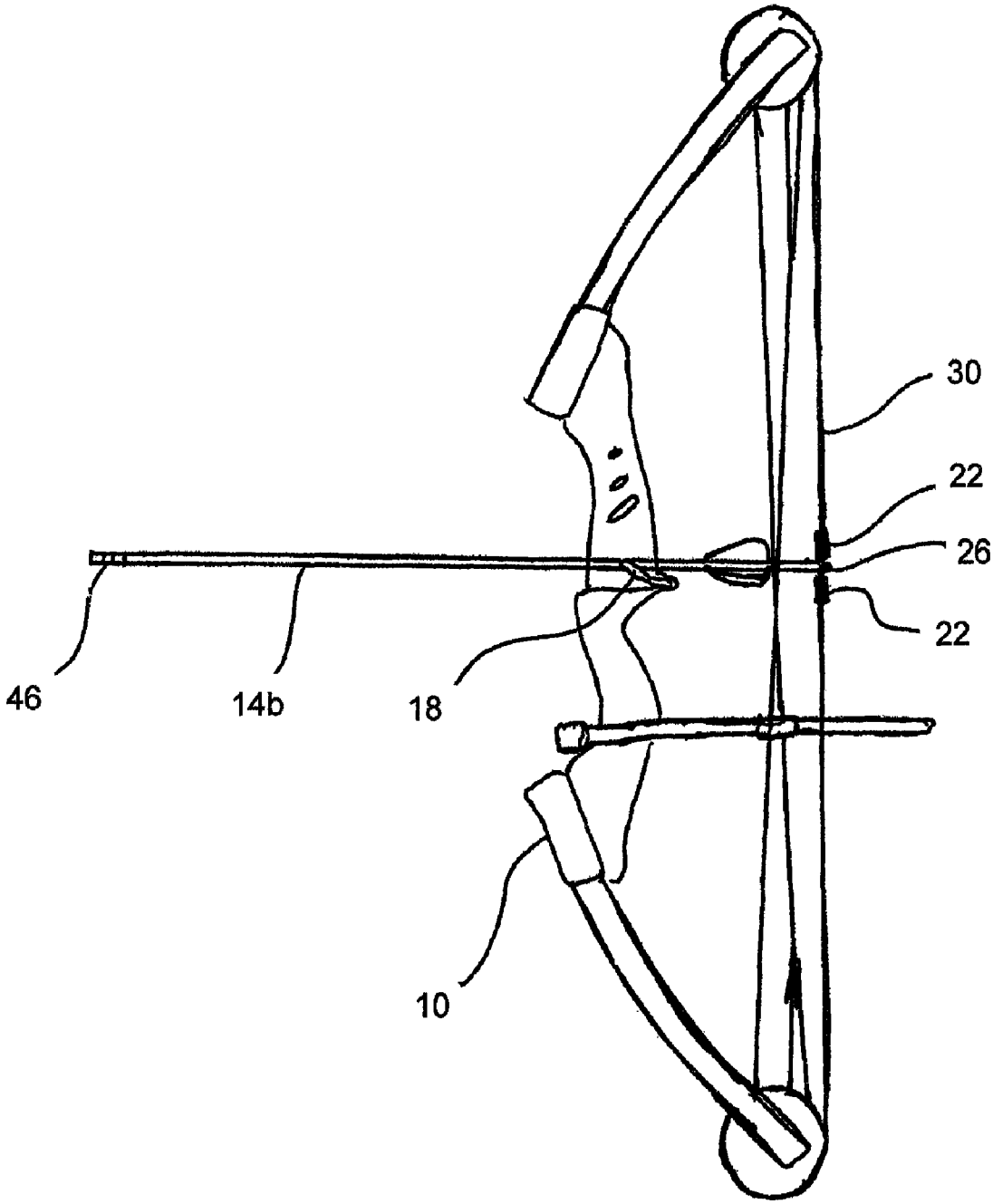
FIG. 6 shows the levels of FIGS. 4A through 5B in use.

FIG. 6 shows a setup arrow 14*b* according to the present invention being used to adjust a bow 10. The setup arrow 14*b* may be a dedicated adjustment arrow having a level 46 permanently affixed to the tip, or may be a conventional arrow with a removable level 46*b* attached thereto. A person may watch the setup arrow 14*b*, and the level 46, 46*b* in particular, to ensure that the arrow remains level as the arrow and bow string 30 are moved from a resting position as shown to a position with the arrow and string extended and ready to fire (as in FIG. 2). The person may use the level 46 to verify that the arrow is level in both positions, and is thus traveling in a straight line and not changing trajectory throughout the motion.

One advantage of the present invention is that position of the arrow 14*b* and the setup of the bow 10 may be corrected and properly adjusted even if the person holds the bow slightly up or slightly down when holding the bow. Accordingly, the system may accommodate a person's natural tendency to hold the bow aimed slightly up or down when intending to hold the bow level. The bow will thus shoot in a comfortable manner for the person while still allowing the bow to be adjusted so that the arrow travels back and forth in a linear trajectory. If the arrow 14*b* is set to be perfectly perpendicular to the bow 10 (level when the bow is perfectly perpendicular to the ground), as typically occurs with the prior art adjustment levels, the arrow may be naturally aimed up or down a little when the person intends to hold the bow level. In such a situation the person may shoot a little too high or too low because of the setup of the bow 10.

The present invention is thus advantageous as it allows a person to setup a bow 10 in a manner which accommodates the natural shooting position of the user. Additionally, the present invention requires fewer pieces and requires the person to monitor fewer levels that prior art devices, typically making the setup procedure quicker and easier to accomplish. The present invention also provides a portable setup level which may be used in the field to both set up bows and to check arrows for accuracy as well as use at home or in a shop to verify the accurate construction of arrows.

There is thus disclosed an improved system for adjusting archery bows and arrows. It will be appreciated that numerous changes may be made to the present invention without departing from the scope of the claims.

What is claimed is:

1. An device for adjusting an archery bow and arrow, the device comprising:

a level;

a stem attached to the level such that the axis of the stem is coincident with the axis of the level, the stem being configured for insertion into the tip of an arrow shaft;

wherein the stem is configured for insertion into a hollow portion of an arrow shaft; and further comprising an arrow having a shaft and a nock, and wherein the stem is inserted into the arrow shaft.

2. The device of claim 1, wherein the level is a bubble level.

3. The device of claim 2, wherein the level is symmetrical about a lengthwise axis.

4. The device of claim 1, wherein the stem is permanently affixed into the arrow shaft.

5. The device of claim 1, wherein the stem is threaded and configured for insertion into a threaded insert, the threaded insert being disposed in the arrow shaft and configured for attaching arrow heads to the arrow.

6. A device for adjusting an archery bow and arrow, the device comprising:

a bubble level, the bubble level having an axis extending lengthwise through the center thereof and being symmetrical about said axis;

a stem attached to the bubble level, the stem being disposed along the axis of the bubble level and being configured for insertion into the tip of an arrow shaft;

wherein the stem is generally cylindrical and configured for insertion into an arrow shaft; and further comprising an arrow, the arrow having a shaft and a nock, the stem being inserted into the shaft at an end of the shaft opposite the nock.

7. The device of claim 6, wherein the stem is threaded, and wherein the stem is configured for threaded insertion into an arrow shaft in place of an arrow head.

8. A method of adjusting an archery bow, the method comprising:

selecting an archery bow;

selecting an arrow, the arrow having a level attached to the tip thereof in place of an arrow head;

loading the arrow into the bow;

drawing the arrow back by pulling on a bow string; and using the level to verify that the arrow travels through a straight trajectory while being drawn.

9. The method of claim 8, wherein the method comprises using only said level to verify the trajectory of the arrow.

* * * * *